US007388122B2

(12) United States Patent
Haga et al.

(10) Patent No.: US 7,388,122 B2
(45) Date of Patent: Jun. 17, 2008

(54) DEWAXING AID

(75) Inventors: Naoki Haga, Yokosuka (JP); Akiyuki Hiraide, Yokosuka (JP)

(73) Assignee: Toho Chemical Industry Co., Ltd, Tokyo (JP)

( * ) Notice: Subject to any disclaimer, the term of this patent is extended or adjusted under 35 U.S.C. 154(b) by 93 days.

(21) Appl. No.: 10/504,685

(22) PCT Filed: Oct. 25, 2002

(86) PCT No.: PCT/JP02/11100

§ 371 (c)(1),
(2), (4) Date: Aug. 16, 2004

(87) PCT Pub. No.: WO03/070858

PCT Pub. Date: Aug. 28, 2003

(65) Prior Publication Data

US 2005/0054775 A1 Mar. 10, 2005

(30) Foreign Application Priority Data

Feb. 22, 2002 (JP) ..... 2002-093268

(51) Int. Cl.
*G07C 7/00* (2006.01)

(52) U.S. Cl. ..... 585/866; 526/318; 526/318.3; 585/809; 585/832; 585/865

(58) Field of Classification Search ..... 585/809, 585/832, 865, 866; 526/318, 318.3
See application file for complete search history.

(56) References Cited

U.S. PATENT DOCUMENTS

| | | | |
|---|---|---|---|
| 3,239,445 | A | 3/1966 | Alton, III et al. |
| 4,191,631 | A | 3/1980 | Grisham, Jr. |
| 4,203,824 | A | 5/1980 | Achia et al. |
| 4,451,353 | A | 5/1984 | Briens et al. |
| 4,594,142 | A | 6/1986 | Achia et al. |
| 4,670,130 | A | 6/1987 | Dekraker et al. |
| 4,728,414 | A | 3/1988 | West et al. |
| 5,098,550 | A | 3/1992 | Mueller et al. |

FOREIGN PATENT DOCUMENTS

| | | | |
|---|---|---|---|
| CA | A-1171810 | | 7/1984 |
| JP | B-40-4210 | | 3/1965 |
| JP | B-45-15379 | | 2/1970 |
| JP | B-49-26922 | | 7/1974 |
| JP | B-49-46361 | | 12/1974 |
| JP | A-53-121803 | | 10/1978 |
| JP | A-53-121804 | | 10/1978 |
| JP | A-53-129202 | | 11/1978 |
| JP | A-54-011104 | | 1/1979 |
| JP | A-54-123102 | | 9/1979 |
| JP | A-55-089392 | | 7/1980 |
| JP | A-57-030792 | | 2/1982 |
| JP | A-60-217218 | | 10/1985 |
| JP | A-61-247793 | | 11/1986 |
| JP | A-07-316567 | | 12/1995 |
| JP | B2 7-116454 | | 12/1995 |
| JP | 336377 | * | 12/2000 |
| JP | A-2000-336377 | | 12/2000 |
| JP | A-2001-158884 | | 6/2001 |
| JP | A 2001-164268 | | 6/2001 |
| JP | A 2002-097477 | | 4/2002 |
| JP | A 2002-097478 | | 4/2002 |
| JP | A 2003-003176 | | 1/2003 |

* cited by examiner

*Primary Examiner*—Robert D. Harlan
(74) *Attorney, Agent, or Firm*—Oliff & Berridge, PLC

(57) ABSTRACT

The present invention relates to dewaxing aids comprising the mixture of two or more polyalkyl(meth)acrylates having an exothermic heat initiation temperature within the specific range when chilled at 30° C./minute rate, to be added together with the wax-containing hydrocarbon oil to the dewaxing solvent.

The dewaxing aid according to the present invention can be used in the solvent dewaxing method containing the stage in which the chilling rate during the chilling is 30° C./minute or higher, is effective for heavy type wax-containing hydrocarbon oils, and is chlorine-free.

1 Claim, No Drawings

DEWAXING AID

TECHNICAL FIELD

The present invention relates to a dewaxing aid used in the dewaxing stage of lubricant production processes. The present invention also relates to a dewaxing aid used in the production of dewaxed oil in the so-called solvent dewaxing method, especially in the dewaxing stage, by dissolving a wax-containing hydrocarbon oil and a dewaxing aid into a dewaxing solvent and chilling, separating-out wax existing in the wax-containing hydrocarbon oil, and separating the separated-out wax by the liquid/solid separation method.

BACKGROUND ART

In general, in order to prepare a hydrocarbon oil from the crude oil, the crude oil is at first subjected to the atmospheric distillation, and then the resulting residual oil is further subjected to the vacuum distillation to be separated into wax-containing hydrocarbon oils with from low to high various viscosities and vacuum distillation residual oils. In addition, the vacuum distillation residual oil is further treated to remove the asphalt component by the solvent deasphalting process so that Brightstock that is wax-containing hydrocarbon oil with the highest degree of viscosity can be produced.

The wax-containing hydrocarbon oils with various viscosities thus obtained become hydrocarbon oils upon a series of treatment stages such as a combination of solvent extraction, hydrogenation refining and dewaxing, or a combination of hydrogenolysis, solvent extraction, hydrogenation refining and dewaxing among other combinations.

The dewaxing process among these production processes described above is the process wherein wax components in a wax-containing hydrocarbon oil are removed and a hydrocarbon oil with low pour point is produced.

Press filtration may be utilized in the process when the dewaxing process is industrially carried out. In this instance, the wax-containing hydrocarbon oil is chilled in the absence of a solvent to separate out wax, and then the wax is subjected to the press filtration. Generally, the dewaxing method with the press filtration process can only treat light type wax-containing hydrocarbon oils because the filtration is limited with viscosity. Thus, a solvent dewaxing method which is capable of treating wax-containing hydrocarbon oils of the light type, the heavy type and the like is universally employed. In the solvent dewaxing method, wax is separated-out and forms a slurry while a wax-containing hydrocarbon oil, a dewaxing solvent and a dewaxing aid are dissolved and chilled. Said slurry is fed to a solid/liquid separator (a filtration apparatus, a centrifugal separator or the like), and a dewaxed oil is obtained by removing the dewaxing solvent upon separation.

Examples of the dewaxing solvent used for the solvent dewaxing method include hydrocarbons (propane, propylene, butane, pentane, and the like), ketones (acetone, methyl ethyl ketone (MEK), methyl isobutyl ketone (MIBK) and the mixtures thereof, and the like), aromatic hydrocarbons (benzene, toluene, xylene, and the like), and mixtures of ketones and aromatic hydrocarbons (MEK/toluene, acetone/benzene, and the like).

A factor limiting the treatment capacity in the solvent dewaxing process is the filtration rate during the filtration removal of the wax from the slurry, and said rate may be influenced by the crystal structure of the wax separated-out. The crystal structure of the wax separated-out is influenced by the operating conditions in the dewaxing process. Particularly, the condition of the wax separated-out such as the size and the crystal structure of the wax, oil in the crystal, and the like dramatically varies for the same wax-containing hydrocarbon oil depending on the change in the conditions such as the chilling rate, the stirring speed, the chilling temperature, and the like, and thus the filtration rate and the yield of the dewaxed oil are affected. Especially, when the wax-containing hydrocarbon oil is Brightstock, the separation by the filtration has often been running into the problems such as a decrease in the filtration rate, a decrease in the yield of the dewaxed oil, an increase in the pour point of the dewaxed oil due to passing of the fine crystals, clogging of the filter, and the like, because the wax crystals are fine. Various improvements have been achieved in the processes in order to improve the filtration rate and the yield of the dewaxed oil, but the method of adding a dewaxing aid has been carried out as a method for easy control as well as great efficiency. In particular, it has been essential to add a dewaxing aid in a autochilling type dewaxing method such as propane dewaxing.

The prior art technologies such as described below heretofore exist for dewaxing aids. The effect of the mixed use of ethylene vinyl acetate copolymers and polyalkylacrylates or polyalkylmethacrylates is disclosed in JP Patent Publication No. Sho 45-15379, JP Patent Publication No. Sho 49-26922, and JP Patent Laid-open No. Sho 54-11104. The effect of alkylnaphthalene condensation products, or the mixed use thereof with polyalkylmethacrylates is described in JP Patent Laid-open No. Sho 45-15379, JP Patent Publication No. Sho 4946361 and JP Patent Laid-open No. Sho 53-129202. The effect of the use of α-olefin polymers, or copolymers of a-olefin and vinyl acetate is described in JP Patent Laid-open No. Sho 53-121804 and JP Patent Laid-open No. Sho 53-121803. The effect of the use of polyalkylacrylates is described in JP Patent Laid-open No. Sho 404210, JP Patent Laid-open No. Sho 54-123102, JP Patent Laid-open No. Sho 57-30792 and JP Patent Laid-open No. Hei 7-316567. The effect of the use of polyvinylpyrrolidone is described in JP Patent Laid-open No. Sho 55-89392. The effect of the use of copolymers of dialkyl fumarate and vinyl acetate is described in JP Patent Laid-open No. Sho 60-217218 and JP Patent Laid-open No. Sho 61-247793.

Among these prior art technologies, the use as dewaxing aid of a copolymer of a compound having reactive double bonds (a reactive monomer) and vinyl acetate is disclosed in JP Patent Publication No. Sho 49-26922, JP Patent Laid-open No. Sho 54-11104, JP Patent Laid-open No. Sho 53-121804, JP Patent Laid-open No. Sho 53-121803, JP Patent Laid-open No. Sho 60-217218 and JP Patent Laid-open No. Sho 61-247793. Compounds with vinyl acetate groups are decomposed by heat and the like, and acetic acid may be generated. Acetic acid in this case displays corrosiveness against metals such as SUS and the like, to say nothing of iron, and thus their presence is not desirable for the apparatus.

In addition, the use of an alkylnathphthalene condensation product as dewaxing aid is disclosed in JP Patent Laid-open No. Sho 45-15379 and JP Patent Publication No. Sho 49-46361. As such alkylnaphthalene condensation products can be generally obtained through Friedel-Crafts reaction using chlorinated paraffin as the raw material, the complete removal of the chlorine content therein is not easy. Recently, however, there has been a strong demand for chlorine-free products in every field.

Furthermore, the use of polyalkylacrylates as dewaxing aids described in the prior art references shows a good performance under the investigation in the laboratory, but a more effective aid is required since they do not show a good effect, especially, against heavy type wax-containing hydrocarbon oil in the evaluation with the actual apparatus in which the chilling rate during the chilling is 30° C./minute or higher.

The problems to be solved by present invention are that the dewaxing method using the dewaxing aid described in the prior art can not be used for the general purposes depending on the kind of wax-containing hydrocarbon oils used and that the shortcomings (containing of chlorine, corrosion of the apparatus by the product at the time of decomposition, and the like) which can not be avoided due to the structure of these compounds and the production method have to be compensated for. That is to say, in the case of the dewaxing method using a dewaxing aids known heretofore, for instance, a polyalkylmethacrylate, the dewaxing aid alone does not show the effect on both the light type and the heavy type wax-containing hydrocarbon oils, and it is required to further add further compounds, such as alkylnaphthalene condensation products which inevitably contain chlorinated compounds due to their production process and copolymers of reactive monomer/vinyl acetate which may liberate monomeric acids during their decomposition due to their structures, as described above.

The present inventors earnestly investigated in order to solve these problems. As the result, the dewaxing aids whose evaluation under the laboratory scale correlating to the evaluation with the actual apparatus in which the chilling rate during the chilling is 30° C./minute or higher have been found under condition of adding prechilling process (rapid chilling process) just like the actual apparatus to the solvent dewaxing method. They further exhibited the effect against any kinds, from the light type to the heavy type, of the wax-containing hydrocarbon oils, and were found to improve the filtration rate and the yield of the dewaxed oils, as compared with the conventional dewaxing aids.

DISCLOSURE OF THE INVENTION

Namely, the present invention relates to a dewaxing aid for use in the dewaxing method to produce a dewaxed oil by dissolving the dewaxing aid together with a wax-containing hydrocarbon oil into a dewaxing solvent, separating-out wax by chilling, and removing the separated-out wax with the liquid/solid separation method, characterized in that said dewaxed aid comprises a mixture of (A) at least one polyalkyl(meth)acrylate having alkyl groups of 10 to 30 carbon atoms, and (B) at least one polyalkyl(meth)acrylate having alkyl groups of 10 to 30 carbon atoms, which is different from component (A), the mass ratio of component (A)/component (B) being 3/97 to 97/3, and that said dewaxing aid satisfies the conditions of formulas (1) and (2) below at the exothermic heat initiation temperature as measured by a differential scanning calorimeter at the chilling rate of 30° C./minute:

$$-4.0°\text{ C.}+Ta \leqq ta \leqq -1.0°\text{ C.}+Ta \quad (1)$$

$$Ta \leqq tb \leqq 4.0°\text{ C.}+Ta \quad (2)$$

wherein (Ta) is the exothermic heat initiation temperature of the wax-containing hydrocarbon oil without the addition of said dewaxing aid, (ta) is the exothermic heat initiation temperature of the wax-containing hydrocarbon oil with the addition of 0.25% by mass of the component (A) to the wax-containing hydrocarbon oil, and (tb) is the exothermic heat initiation temperature of the wax-containing hydrocarbon oil with the addition of 0.25% by mass of the component (B) to the wax-containing hydrocarbon oil.

Dewaxing methods in which the dewaxing aid of the present invention is effective is solvent dewaxing methods wherein the chilling rate during the chilling is 30° C./minute or higher. Examples of such methods are the dewaxing method using hydrocarbons which are gaseous at the normal temperature (propane, propylene, butane, butene, and the like), the dewaxing method using ketones (acetone, methyl ethyl ketone (MEK), methyl isobutyl ketone (MIBK), and the like, and the mixture thereof), the dewaxing method using aromatic hydrocarbons (benzene, toluene, xylene, and the like), and the dewaxing method using mixtures of ketones and aromatic hydrocarbons (MEK/toluene, acetone/benzene, and the like) among other methods.

Heavy type wax-containing hydrocarbon oils in the present specification mean wax-containing oils which, after dewaxed, have a kinematic viscosity at 40° C. in the range of 60 to 150 $mm^2/s$, and light type wax-containing oils mean wax-containing oils which, after dewaxed, have a kinematic viscosity at 40° C. in the range of 10 to 60 $mm^2/s$.

The component (A) and the component (B) that are polyalkyl (meth)acrylates having alkyl groups of 10 to 30 carbon atoms may each be one or a mixture of more than one. In addition, these polymers may consist of one type of monomer or a combination of different monomers.

General examples of alkyl(meth)acrylates having alkyl groups of 10 to 30 carbon atoms which are the monomers constituting the component (A) and the component (B) are decyl(meth)acrylate, undecyl(meth)acrylate, dodecyl(meth) acrylate, tridecyl(meth)acrylate, tetradecyl(meth)acrylate, pentadecyl(meth)acrylate, hexadecyl(meth)acrylate, heptadecyl(meth)acrylate, octadecyl(meth)acrylate, nonadecyl (meth)acrylate, eicosyl(meth)acrylate, docosylacrylate and the like and the mixture thereof.

Here, the existing mass ratio (A):(B) of the component (A) to the component (B) is 3:97 to 97:3, and a good dewaxing effect can not be obtained against the heavy type wax-containing hydrocarbon oils unless the ratio is within this range. The ratio is especially preferable in the range between 10:90 to 90:10 for performance.

Further, the component (A) is preferably the one with a weight-average molecular weight of 10,000 to 800,000 having alkyl chain length of 10 to 20 carbon atoms. In addition, the component (B) is preferably the one with a weight-average molecular weight of 10,000-800,000 having alkyl chain length of 16 to 30 carbon atoms. When said weight-average molecular weight is less than 10,000, the performance as a dewaxing aid may not sometimes be manifested, and when said weight-average molecular weight is greater than 800,000, it is undesirable because the solubility characteristics into wax-containing hydrocarbon oils or dewaxing solvents grow worsen.

The component (A) and the component (B) can be synthesized according to any prior art method. For example, they may be obtained through the radical polymerization using peroxides or azo-bis type compounds as initiators, or the heat polymerization, after the esterification reaction of alcohol having 10 to 30 carbon atoms with methacrylic acid or acrylic acid.

Moreover, the dewaxing aid according to the present invention may contain further additives within the range that does not impair the effect of the present invention. Examples of additives which is thought to be combinable upon the consideration of dewaxing performance (with respect to the improvement in the dewaxing rate, the dewaxed oil yield) are polyalkylacrylates or polyalkylmethacrylates other than the component (A) and the component (B), or copolymers of alkylacrylates with alkylmethacrylates, alkylnaphthalene condensation products, or copolymers of ethylene with vinyl acetate, and the like,.

The dewaxing aid according to the present invention can be used in, for instance, the following dewaxing method. At first, a wax-containing hydrocarbon oil is dissolved into a dewaxing solvent and the dewaxing aid according to the present invention is added, homogenized and heated. Next, the mixture is chilled to the predetermined temperature. The slurry comprising the wax separated-out, the dewaxed oil, the dewaxing solvent and the dewaxing aid is formed in this chilling process, and then said slurry is subjected to the wax separation by a liquid/solid separation method such as filtration or centrifugal filtration to obtain the dewaxed oil upon removal of the dewaxing solvent. The performance of the dewaxing aid can be evaluated by measuring the filtration rate and the dewaxed oil yield in the aforementioned process.

In addition, the exothermic heat initiation temperature for the dewaxing aid according to the present invention may be measured with a differential scanning calorimeter such as a thermal analyzer DSC-6200 by Seiko Instruments Inc. and the temperature, at which the exothermic heat initiated by extrapolation when chilling is conducted, for example, at the chilling rate of 30° C./minute from 140° C. to −30° C., is taken as the exothermic heat initiation temperature. For the measurement, a poly(meth)acrylate which becomes the dewaxing aid is added to the wax-containing hydrocarbon oil so as to be the concentration of 0.25% by mass to said wax-containing hydrocarbon oil, and solution-mixed, and 5 mg of this mixture is used.

BEST MODE FOR CARRYING OUT THE INVENTION

The present invention is explained by showing Synthetic Examples of the component (A) and the component (B), Working Examples, and Test method in the followings, but the present invention is not be limited by such Synthetic Examples of the component (A) and the component (B), Working Examples and Test methods.

SYNTHETIC EXAMPLE 1

A flask equipped with a stirrer, a nitrogen blowing tube, a thermometer and a condenser is charged with 40 parts of an alkylmethacrylate having 12 to 18 carbon atoms (C12=15%, C14=18%, C16=25%, C18=42%) and 60 parts of a mineral oil, and the nitrogen displacement was completely done for 3 hours. Upon addition of the initiator, heating to 100° C. and aging for 8 hours at that temperature, a polyalkylmethacrylate with weight-average molecular weight of 400,000 was obtained. The compound obtained by this process was named as aid (1).

SYNTHETIC EXAMPLE 2

A flask equipped with a stirrer, a nitrogen blowing tube, a thermometer and a condenser is charged with 40 parts of an alkylacrylate having 18 to 22 carbon atoms (C18=43%, C20=11%, C22=44%) and 60 parts of a mineral oil, and the nitrogen displacement was completely done for 3 hours. Upon addition of the initiator, heating to 100° C. and aging for 8 hours at that temperature, a polyalkylacrylate with weight-average molecular weight of 400,000 was obtained. The compound obtained by this process was named as aid (2).

SYNTHETIC EXAMPLE 3

A flask equipped with a stirrer, a nitrogen blowing tube, a thermometer and a condenser is charged with 40 parts of an alkylmethacrylate having 6 to 10 carbon atoms (C6=5%, C8=75%, C10=20%) and 60 parts of a mineral oil, and the nitrogen displacement was completely done for 3 hours. Upon addition of the initiator, heating to 100C and aging for 8 hours at that temperature, a polyalkylmethacrylate with weight-average molecular weight of 400,000 was obtained. The compound obtained by this process was named as aid (3).

SYNTHETIC EXAMPLE 4

A flask equipped with a stirrer, a nitrogen blowing tube, a thermometer and a condenser is charged with 40 parts of an alkylacrylate having 12 to 15 carbon atoms (C12=20%, C13=31%, C14=33%, C15=16%) and 60 parts of a mineral oil, and the nitrogen displacement was completely done for 3 hours. Upon addition of the initiator, heating to 100° C. and aging for 8 hours at that temperature, a polyalkylacrylate with weight-average molecular weight of 400,000 was obtained. The compound obtained by this process was named as aid (4).

The dewaxing aid according to the present invention which is the mixture combining said aids (1) to (4) was used in the solvent dewaxing method outlined below. That is to say, a wax-containing hydrocarbon oil was dissolved into a dewaxing solvent, and the dewaxing aid according to the present invention was added, homogenized and heated. Next, the mixture was chilled to the predetermined temperature. The slurry comprising the wax separated-out, the dewaxed oil, the dewaxing solvent and the dewaxing aid is formed in this chilling process, and then said slurry is subjected to the wax separation by filtration to obtain the dewaxed oil upon removal of the dewaxing solvent. The performance of the dewaxing aid was evaluated by measuring the filtration rate and the dewaxed oil yield in the aforementioned process.

The Measuring Method for the Exothermic Heat Initiating Temperature of Each Aid:

The thermal analyzer DSC-6200 by Seiko Instruments Inc. was used as the differential scanning calorimeter.

Poly(meth)acrylates which comprise the dewaxing aid were added to the wax-containing hydrocarbon oil (heavy type, an exothermic heat initiation temperature of 46.7° C.) so as to be the concentration of 0.25% by mass to said wax-containing hydrocarbon oil and solution-mixed, 5 mg of this mixture was harvested, and the temperature, at which the exothermic heat initiated by extrapolation when chilling is conducted at the chilling rate of 30° C./minute from 140° C. to −30° C., was taken as the exothermic heat initiation temperature.

Test Method:

The wax-containing hydrocarbon oil (heavy type, an exothermic heat initiation temperature of 46.7° C.) was heated at 50° C. to dissolve it into normal hexane (quadruple against the wax-containing hydrocarbon oil), and the dewaxing aid synthesized above was added and chilled with stirring to 30°0 C. at the chilling rate of 30° C./minute, and then chilled to −40° C. at the chilling rate of 2° C./minute. The resultant slurry comprising the wax, normal hexane, the dewaxed oil and the dewaxing aid was then filtered under a reduced pressure at 600 mmHg at −40° C. through a Buchner funnel with a cooling jacket circulated with −40° C. refrigeration medium.

The amount of filtrate filtered in 2 minutes was measured, and filtration rate was calculated according to the formula below. In addition, normal hexane contained in each of the filtrate and in the wax after filtration was removed by the vacuum topping, each mass was measured and the dewaxed oil yield was calculated according to the formula below.

The Calculation Formula for the Filtration Rate (mL/s·cm$^2$):

$$\frac{\text{The amount of the filtrate filtered in 120 seconds (mL)}}{120\ (\text{s}) \times \text{effective filtration area (cm}^2)} = \text{Filtration rate}$$

The Calculation Formula for the Dewaxed Oil Yield (mass %):

$$\frac{\left[\begin{array}{l}\text{The filtrate mass after the}\\ \text{removal of normal hexane}\end{array}\right] \times 100}{\left[\begin{array}{l}\text{The filtrate mass}\\ \text{after the removal}\\ \text{of normal hexane}\end{array}\right] + \left[\begin{array}{l}\text{The wax mass}\\ \text{after the removal}\\ \text{of normal hexane}\end{array}\right]} = \text{The dewaxed oil yield}$$

WORKING EXAMPLE 1

0.50 g of the aid (1) according to the present invention obtained in SYNTHETIC EXAMPLE 1 and 0.50 g of the aid (2) according to the present invention obtained in SYNTHETIC EXAMPLE 2 were each added and dissolved into 200 g of the heavy type wax-containing hydrocarbon oil while heating, and further dissolved with the addition of 700 mL normal hexane, and the test was conducted according to Test method. That is to say, the amount to be added of the mixture consisting of the aid (1) and the aid (2) according to the present invention was set at 0.5% by mass (0.20% by mass when converted to the pure substance of the aids) to the heavy type wax-containing hydrocarbon oil, and the test was conducted.

WORKING EXAMPLE 2

0.90 g of the aid (1) according to the present invention obtained in SYNTHETIC EXAMPLE 1 and 0.10 g of the aid (2) according to the present invention obtained in SYNTHETIC EXAMPLE 2 were each added and dissolved into 200 g of the heavy type wax-containing hydrocarbon oil while heating, and further dissolved with the addition of 700 mL normal hexane, and the test was conducted according to Test method. That is to say, the amount to be added of the mixture consisting of the aid (1) and the aid (2) according to the present invention was set at 0.5% by mass (0.20% by mass when converted to the pure substance of the aids) to the heavy type wax-containing hydrocarbon oil, and the test was conducted.

WORKING EXAMPLE 3

0.10 g of the aid (1) according to the present invention obtained in SYNTHETIC EXAMPLE 1 and 0.90 g of the aid (2) according to the present invention obtained in SYNTHETIC EXAMPLE 2 were each added and dissolved into 200 g of the heavy type wax-containing hydrocarbon oil while heating, and further dissolved with the addition of 700 mL normal hexane, and the test was conducted according to Test method. That is to say, the amount to be added of the mixture consisting of the aid (1) and the aid (2) according to the present invention was set at 0.5% by mass (0.20% by mass when converted to the pure substance of the aids) to the heavy type wax-containing hydrocarbon oil, and the test was conducted.

COMPARATIVE EXAMPLE 1

0.50 g of the aid (3) according to the present invention obtained in SYNTHETIC EXAMPLE 3 and 0.50 g of the aid (4) obtained according to the present invention in SYNTHETIC EXAMPLE 4 were each added and dissolved into 200 g of the heavy type wax-containing hydrocarbon oil while heating, and further dissolved with the addition of 700 mL normal hexane, and the test was conducted according to Test method. That is to say, the amount to be added of the mixture consisting of the aid (3) and the aid (4) according to the present invention was set at 0.5% by mass (0.20% by mass when converted to the pure substance of the aids) to the heavy type wax-containing hydrocarbon oil, and the test was conducted.

COMPARATIVE EXAMPLE 2

0.50 g of the aid (1) according to the present invention obtained in SYNTHETIC EXAMPLE 1 and 0.50 g of the aid (3) according to the present invention obtained in SYNTHETIC EXAMPLE 3 were each added and dissolved into 200 g of the heavy type wax-containing hydrocarbon oil while heating, and further dissolved with the addition of 700 mL normal hexane, and the test was conducted according to Test method. That is to say, the amount to be added of the mixture consisting of the aid (1) and the aid (3) according to the present invention was set at 0.5% by mass (0.20% by mass when converted to the pure substance of the aids) to the heavy type wax-containing hydrocarbon oil, and the test was conducted.

COMPARATIVE EXAMPLE 3

0.50 g each of the aid (2) according to the present invention obtained in SYNTHETIC EXAMPLE 2 and the aid (3) according to the present invention obtained in SYNTHETIC EXAMPLE 3 was added and dissolved into 200 g of the heavy type wax-containing hydrocarbon oil while heating, and further dissolved with the addition of 700 mL normal hexane, and the test was conducted according to Test method. That is to say, the amount to be added of the mixture consisting of the aid (2) and the aid (3) according to the present invention was set at 0.5% by mass (0.20% by mass when converted to the pure substance of the aids) to the heavy type wax-containing hydrocarbon oil, and the test was conducted.

COMPARATIVE EXAMPLE 4

The test was conducted for a heavy type wax containing hydrocarbon oil without the use of any aid.

The exothermic heat initiation temperatures for the mixtures of each aid and the wax-containing hydrocarbon oil described above are shown in Table 1, and the dewaxing performance for the heavy type wax-containing hydrocarbon oil obtained in Working Examples 1 to 3 and Comparative Examples 1 to 4 is shown in Table 2.

TABLE 1

| Aid | Exothermic heat initiation temperature (° C.) |
|---|---|
| No addition | 46.7 |
| (1) | 48.5 |
| (2) | 44.0 |
| (3) | 46.2 |
| (4) | 47.0 |

TABLE 2

| | Dewaxing performance for heavy type wax-containing hydrocarbon oil | | | |
|---|---|---|---|---|
| | De-waxing aid | Amount to be added (converted to the effective component) (%) | Filtration rate (mL/s · cm$^2$) | Dewaxed oil yield (%) |
| Working Example 1 | (1)/(2) | (1)/(2) = 0.10:0.10 | 2.0 | 68.0 |
| Working Example 2 | (1)/(2) | (1)/(2) = 0.18:0.02 | 2.2 | 65.2 |
| Working Example 3 | (1)/(2) | (1)/((2) = 0.02:0.18 | 2.5 | 63.6 |
| Comparative Example 1 | (3)/(4) | (3)/(4) = 0.10:0.10 | 1.2 | 52.6 |
| Comparative Example 2 | (1)/(3) | (1)/(3) = 0.10:0.10 | 1.5 | 54.5 |
| Comparative Example 3 | (2)/(3) | (2)/(3) = 0.10:0.10 | 1.5 | 55.1 |
| Comparative Example 4 | No addition | — | 0.7 | 49.5 |

It is apparent from Table 2 that the use of the dewaxing aids according to the present invention in the dewaxing process with the rapid chilling greatly improves both the filtration rate and the dewaxed oil yield. This is a remarkable effect attained by the product according to the present invention.

The invention claimed is:

1. A method to produce a dewaxed oil, comprising:

dissolving a dewaxing aid together with a wax-containing hydrocarbon oil into a dewaxing solvent, separating-out wax by chilling, wherein the chilling rate during the chilling is 30° C./minute or higher, and removing the separated-out wax with the liquid/solid separation method;

wherein the dewaxing aid comprises a mixture of:

(A) at least one polyalkyl(meth)acrylate having alkyl groups of 10 to 30 carbon atoms, and (B) at least one polyalkyl(meth)acrylate having alkyl groups of 10 to 30 carbon atoms which is different from component (A), wherein:

the mass ratio of component (A)/component (B) is from 3/97 to 97/3, and the dewaxing aid satisfies the conditions of formulas (1) and (2) below at the exothermic heat initiation temperature as measured by a differential scanning calorimeter at the chilling rate of 30 °C/minute:

$$-4.00° \text{ C.}+Ta \leqq ta \leqq -1.0° \text{ C.}+Ta \quad (1)$$

$$Ta \leqq tb \leqq 4.00° \text{ C.}+Ta \quad (2)$$

where:

(Ta) is the exothermic heat initiation temperature of the wax-containing hydrocarbon oil without the addition of said dewaxing aid, (ta) is the exothermic heat initiation temperature of the wax-containing hydrocarbon oil with the addition of 0.25% by mass of the component (A) to the wax-containing hydrocarbon oil, and (tb) is the exothermic heat initiation temperature of the wax-containing hydrocarbon oil with the addition of 0.25% by mass of the component (B) to the wax-containing hydrocarbon oil.

* * * * *